US005802014A

United States Patent [19]

Danko

[11] Patent Number: 5,802,014

[45] Date of Patent: Sep. 1, 1998

[54] PORTABLE TABLET REMINDER AND DISPENSING SYSTEM

[76] Inventor: Delicia R. Danko, 4289 Ironwood Ave., Seal Beach, Calif. 90740

[21] Appl. No.: 717,888

[22] Filed: Sep. 23, 1996

[51] Int. Cl.[6] ..... G04B 47/00; A44C 11/00

[52] U.S. Cl. ..... 368/10; 368/282; 224/165

[58] Field of Search ..... 368/10, 276, 278, 368/281, 282; 221/2, 3, 15; 224/165

[56] References Cited

U.S. PATENT DOCUMENTS

| | | | |
|---|---|---|---|
| 4,483,626 | 11/1984 | Noble | 368/10 |
| 4,695,954 | 9/1987 | Rose et al. | 364/413 |
| 4,748,600 | 5/1988 | Urquhart | 368/10 |
| 4,785,981 | 11/1988 | Rodman | 224/165 |
| 4,926,572 | 5/1990 | Holmes | 40/448 |
| 5,050,142 | 9/1991 | Gibbs | 368/11 |
| 5,157,640 | 10/1992 | Backner | 368/10 |
| 5,181,189 | 1/1993 | Hafner | 368/10 |
| 5,233,571 | 8/1993 | Wirtschafter | 368/10 |
| 5,239,491 | 8/1993 | Mucciacciaro | 364/569 |
| 5,408,443 | 4/1995 | Weinberger | 368/10 |

*Primary Examiner*—Vit W. Miska
*Attorney, Agent, or Firm*—Goldstein & Associates

[57] ABSTRACT

A strap-on tablet dispensing system includes a system unit providing timing and alarm functions, a strap arrangement, and a plurality of tablet containers fixed to the strap arrangement. The tablet dispensing system is arranged to hold a plurality of tablet medications and indicate to the wearer, via prompts, the proper times to ingest one or more tablets from one or more tablet containers. A plurality of microswitches are also be provided to enable the system to verify that the indicated tablet container or containers are accessed. The tablet dispensing system may be arranged to support the downloading of programming and configuration information directly from a host computer into the tablet dispensing system.

8 Claims, 3 Drawing Sheets

PORTABLE TABLET REMINDER AND DISPENSING SYSTEM

BACKGROUND OF THE INVENTION

1. Field of the Invention

The present invention relates generally to tablet and pill dispensing systems. More particularly, the invention relates to tablet dispensing watch having a tablet storage capability and alarm to indicate when one or more medicinal tablets are to be ingested.

2. Background and Objects of the Invention

The need for individuals to ingest medications in the form of tablets at known and fixed time intervals is well known in the art. The tablets may include off-the-shelf and prescription tablets (e.g., pills). A key concern in order to realize the maximum benefit from such medications is to adhere to the proper time intervals between dosages, along with the proper dosages, that are stipulated. For example, the ingestion of certain medications, such as antibiotics, must done on a precise schedule with a prescribed dosage. If dosages are missed, or taken at times other than those indicated, the associated benefits from taking such tablets may be diminished or possibly eliminated. Further, improper dosages of certain medications may result in the injury of an individual, or in rare instances their death.

The demands placed on an individual is often worsened by the necessity to ingest a variety of tablets, wherein each type of tablet must be taken at differing time intervals and dosages. That is, although the interval and dosage for ingesting each type of tablet is known, it is not difficult for an individual to be medicated to forget, or be confused and overwhelmed by the regiment that must be followed to properly ingest the tablets. This is especially true in the case of elderly or seriously ill persons.

There are many pill and tablet dispensing systems and devices known in the art. Many of these systems provide one or more compartments, to hold and organize the tablets to be taken. For example, there are "table-top" systems known that provide a plurality of compartments to hold and organize a significant number of medications/tablets. Some of these systems are arranged to "group" the tablets that are to be ingested at a given time, say in the morning or at bedtime. However, systems of this type assume each pill in the group should be taken at the same time. Although this assumption may be true for certain tablets, such as vitamins, or for one or more dosages which may coincide (in their time to be ingested), this is often generally not the case for medicinal tablets and pills. The "table-top" systems are also only suitable for a person that is always present at the same location when medicine is to be dispensed and ingested.

Other devices are known in the art that allow the dosages of tablets to be organized for a substantial period of time. For example, the dosage of a weeks worth of one or more tablets may be organized and stored in such devices. These devices may be appropriate to organize the required medications, and further to monitor "missed" dosages, but are of no help in reminding an individual of the times to ingest the tablets. Still other devices are known that include timing and alarm arrangements that sound an alarm or audio prompt, but do not specifically indicate which tablet or tablets to ingest, and further do not "verify" that the correct medication/tablet is being taken.

There are yet other devices known that in a rudimentary way assist in the dispensing of tablets. For example, there exists in the art simple gadgets that attach to tablet/pill containers, having a clock face or readout, wherein the time for the next dosage may be manually set or indicated. These crude devices may be helpful to some individuals, but are not suitable for use with older and/or seriously ill individuals who must remember to check each container to determine if the time to ingest a tablet has arrived.

When considering the problems and drawbacks of current tablet and pill dispensing devices, including those discussed above, there is a need for new and improved systems that provide both dispensing and alarm/reminder capabilities, while also verifying and assisting an individual in taking the proper tablets at the proper times. Objects of the present invention are, therefore, to provide new and improved tablet dispensing systems having one or more of the following capabilities, features, and/or characteristics:

- a small self-contained dispensing arrangement;
- having a plurality of tablet containers to hold a variety of tablets;
- supports the dispensing of tablets in a convenient and simple manner;
- providing an alarm and reminder means to indicate which tablet or tablets are to be taken at a given time;
- means to verify the correct tablet container is being accessed at the proper time;
- a small portable system that may be strapped to, and worn by, an individual to be medicated;
- arranged to support the "downloading" of information related to the dosage and required intervals for one or more tablets;
- supports the remote monitoring of the tablet containers that are accessed to ingest one or more tablets at the time a person is prompted to do so;
- enables the remote verification that a tablet holding container is actually accessed to remove one or more tablets therefrom, and
- a user friendly system using many "off-the-shelf" components.

The above listed objects, advantages, and associated novel features of the present invention, as well as others, will become more clear from the description and figures provided herein. Attention is called to the fact, however, that the drawings are illustrative only. Variations are contemplated as being part of the invention, limited only by the scope of the appended claims.

SUMMARY OF THE INVENTION

In accordance with the invention, a strap-on tablet dispensing system, arranged to hold a plurality of predetermined tablets and indicate to a wearer the proper times to ingest at least one of the tablets, includes a programmable system unit arranged to issue one or more predetermined prompts to the wearer at predetermined times or time intervals. Also included is a strap means arranged to enable the tablet dispensing system to be strapped on the wearer like an ordinary wristwatch, and a plurality of tablet containers attached to the strap means and configured to hold a plurality of tablets therein. Each tablet container has an internal compartment to securely hold the tablets and an access arrangement providing access to the internal compartment to remove tablets therefrom when a wearer is instructed to do so via the prompts issued by the system unit. The system unit is programmed to indicate to the wearer at least one of the time of day, the date, the tablet container to access tablets therefrom, the number of tablets to ingest, and prompts to indicate to the wearer that at least one of the plurality of tablets is to be presently ingested.

The tablet dispensing system further includes a plurality of microswitches, one installed on each of the tablet containers and coupled to the controller and timer module of the system unit so as to indicate thereto when at least one of the tablet containers are accessed. The microswitches thereby providing a verification means to verify that the correct tablet container is accessed after a wearer is instructed to ingest that tablet.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

It is important to clearly define and establish several terms that will be used throughout this disclosure. The term "tablet" will be defined as any tablet or pill that may be obtained off-the-shelf or as a prescription medication. The term "system unit", as used when referring to a component of the tablet dispensing system disclosed herein, may or may not assume the shape and general appearance of a conventional wrist-watch. The term "micro-switch" is intended to include any switch means that will support the detecting of an access to an associated tablet holding container. Further the terms "system", "dispensing system", and "tablet dispensing system", are to be assumed to be equivalent and interchangeable terms.

Figure 1A:
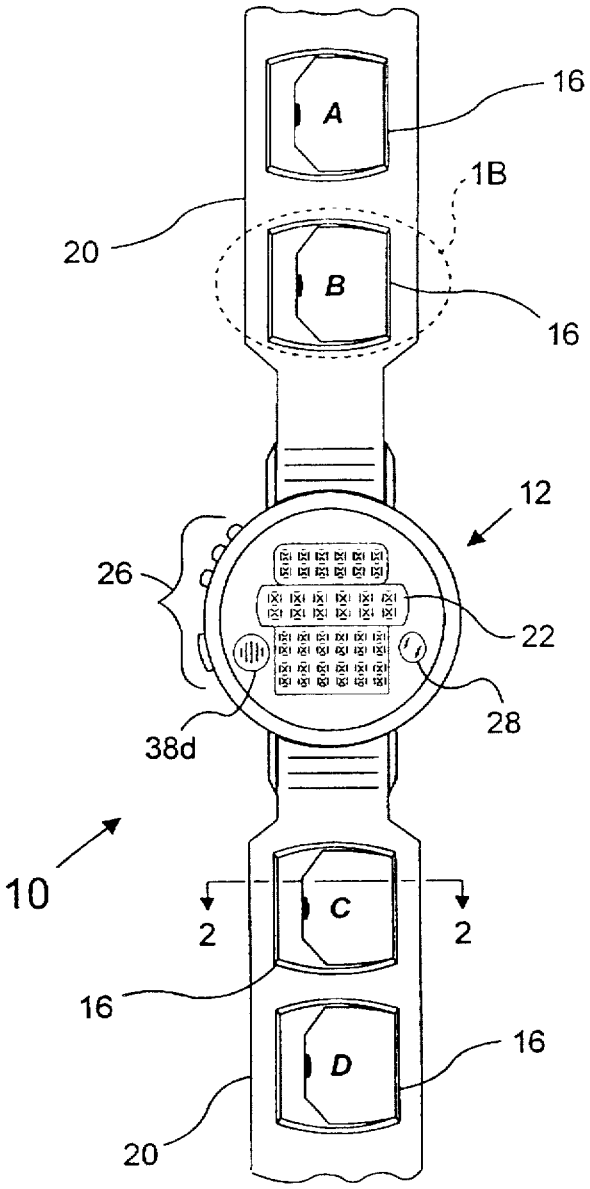
FIG. 1A provides a top view of an embodiment of a tablet dispensing system in accordance with the invention.

Referring now to FIG. 1A, there is shown an embodiment of a tablet dispensing system 10 in accordance with the present invention. Included with the system 10 is a system unit 12 and a strap means 20. The system unit 12 is provided with a display 22 and momentary button switches 26, much as a conventional digital or analog wrist watch may be. The display 22 is provided to indicate a variety of information to the wearer, including visually issued prompts and messages associated with the tablets to be ingested. The momentary button switches 26 are included to enable the wearer to input information and any required responses to the system unit 12, as required for the operation and usage of the system 10. The strap means 20 is arranged to enable the strapping of the tablet dispensing system 10 onto the wearer. The strapping may position the system 10 around a wearer's wrist, arm, leg, neck, or other suitable location on the wearer. Generally, the strap means 20 is provided to insure the wearer will hear (and hopefully respond to) audio prompts to ingest one or more tablets, and to further insure the tablets to be taken are always within the easy reach of the person to be medicated (i.e. the wearer).

Figure 1B:
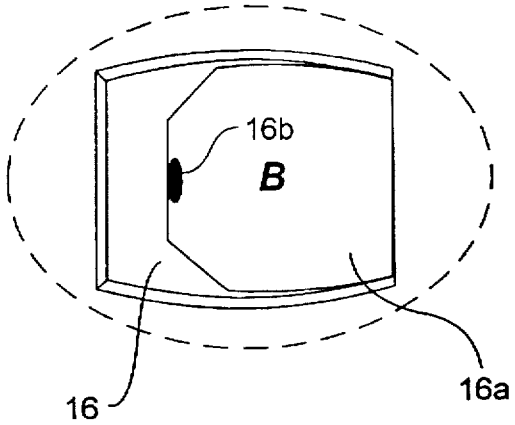
FIGS. 1B depicts an enlarged view of an embodiment of one of the plurality of tablet containers shown in FIG. 1A.
Figure 2:
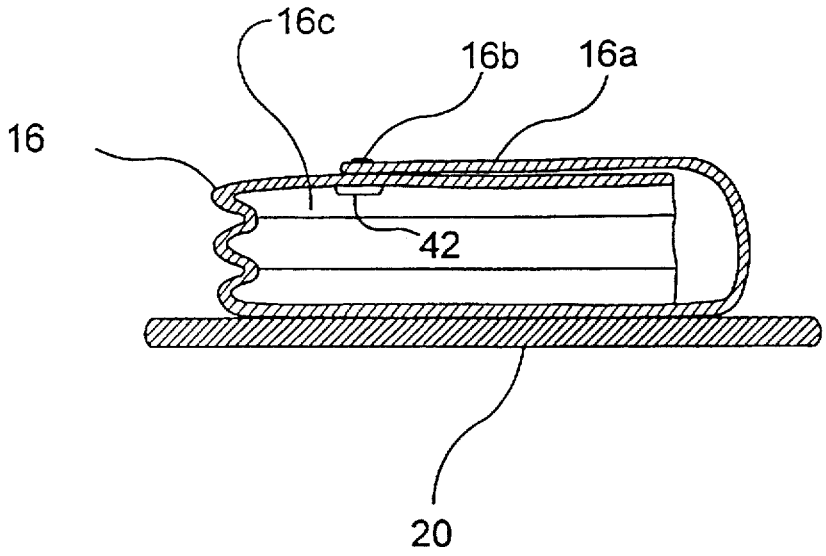
FIG. 2 illustrates a cross sectional view of tablet container C of FIG. 1A.

Also provided with the tablet dispensing system 10, and illustrated in FIGS. 1A, 1B, and 2, are a plurality of tablet containers 16, which are attached to the strap means 20, and arranged to hold a plurality of tablets therein. Each tablet container 16 has an internal compartment **16*c*, as shown in FIG. 2, which is employed to securely hold a plurality of tablets. Accordingly, each tablet container 16 includes an access arrangement that is illustrated in the form of a flap 16*a*. The flap 16*a* (i.e. the access arrangement) provides access to the internal compartment 16*c* when a wearer, or possibly another individual, must fill a tablet container 16, or alternately when a wearer needs to remove one or more tablets therefrom (when instructed to do so via the prompts issued by the system unit 12). A latch 16*b* may be required to secure flap 16*a* in a closed position to securely hold the tablets placed in a tablet container 16**.

It should be understood that many varying embodiments of the tablet container 16 and the access arrangement (provided by the flap **16*a*) are possible. For example, the pouch-like tablet containers 16 may be provided by molded plastic containers (not shown) having a hinged lid. Accordingly, the tablet containers 16 that are shown in FIGS. 1A, 1B, and 2, are illustrative only, and any suitable tablet container is contemplated as being within the scope of the present invention. Further, each respective tablet container 16 may be employed to hold the same type of tablet, or to group a plurality of dissimilar tablets. Therefore, one or more tablet containers may be provided with a dosage comprised of a plurality of differing medications to be ingested at the same time. Other tablet containers (of the same tablet dispensing system 10**) may contain a plurality of the same tablet, to be taken at a predetermined times or time intervals (e.g., every four hours).

Returning to FIG. 1A, further included with the system unit 12 is a miniature speaker device **38*d* and an optical portal 28. The speaker device 38*d* enables the system unit 12 to issue various audio prompts to the wearer at predetermined times. The audio prompts may be employed to indicate to a wearer when one or more tablets are to be ingested, and further to issue reminders until the system unit 12 determines (to the best of its inherent capability) that the proper tablet or tablets have been ingested in a timely manner. The optical portal 28 shown in FIG. 1A provides an optical window for a wireless line-of-sight port to support the exchange of information, preferably in the form of infrared pulsed data, between the system unit 12 and a properly configured host computing means (not shown). The optical portal, 28** and the associated function thereof, will be addressed in greater detail below when referring to FIG. 3.

Figure 3:
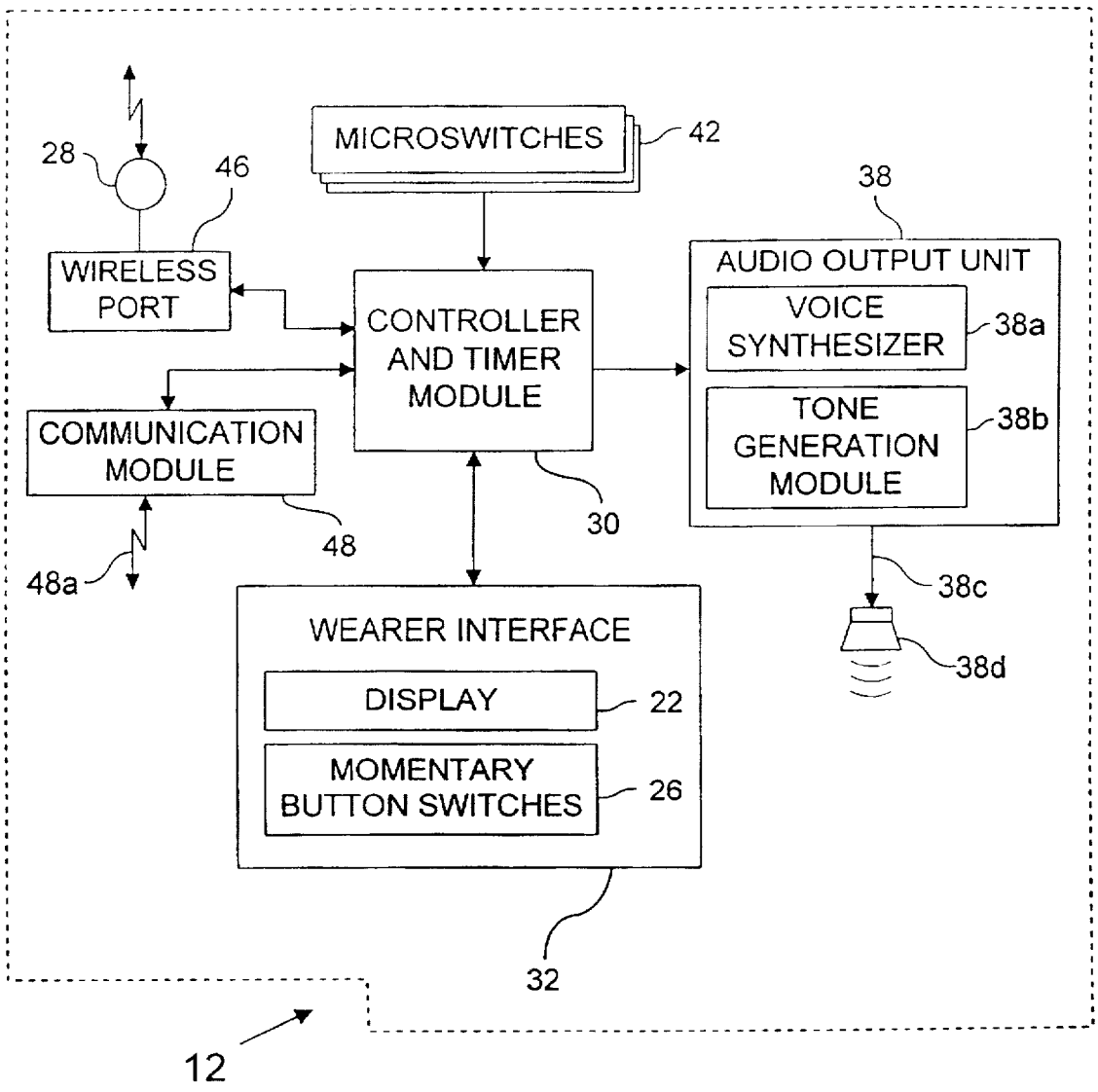
FIG. 3 is a block diagram of an embodiment of the tablet dispensing system.

Referring now to FIG. 3, illustrated is a block diagram of an embodiment of the tablet dispensing system 10. A controller and timer module 30 provides the functional and operational characteristics of the system 10, including the capability to provide the wearer with various prompts and other information, receive information from the wearer (via the momentary button switches 26), and possibly receive information from one or more external sources (e.g., a remote host computing means). In preferred embodiments the controller and timer module 30 would be provided by known "circuit-on-board" microcontrollers having a processor, associated program and data memory, and other known components, mounted directly on a miniature circuit board. These types of circuit implementations tend to be very compact. Those skilled in the art can supply suitable devices and arrangements to implement the controller and timer module 30.

Returning to FIG. 3, a wearer interface 32 is provided to issue prompts (i.e., messages and information) to the wearer and to enable the wearer to indicate information and responses to the system. Accordingly, the wearer interface 32 includes the display 22 to indicate information to the wearer including visually issued messages, and further provides momentary button switches 26 to enable the wearer to input information and responses to the controller and timer module 30. For example, a wearer may be required to press one of the momentary button switch 26 to indicate to the controller and timer module 30 (and generally to the system unit 12) that a tablet dosage has been ingested. It should be noted that the display 22 may be provided in an analog form, or preferably in a digital form. Also shown in FIG. 3 is an audio output unit 38, which includes a voice synthesizer 38*a* and a tone generation module 38*b*, and provided to issue audio prompts in the form of tones and audio messages to the wearer at predetermined times. Those skilled in the art will appreciate the large number of arrangements that are known in the art to generate tones and voice-like synthesized messages. It should be noted that the voice synthesizer 38*a* and the tone generation module 38*b* may be provided by a single "combined" unit or circuit. Regardless of the actual embodiment, the audio output unit 38 may be configured to issue audio prompts that include tones, voice synthesized messages, or both. The audio output signal 38*c* may be coupled and applied to known audio output devices, such as the miniature speaker device 38*d* of FIG. 1A.

As illustrated in FIGS. 2 and 3, a plurality of microswitches 42 are included with the tablet dispensing system 10, wherein one microswitch is installed on each of the tablet containers and coupled to the controller and timer module 30. Each microswitch 42 is arranged to indicate to the controller and timer module 30 when an associated tablet container (wherein the microswitch is installed) is accessed (i.e. opened) to remove one or more tablets therefrom. The microswitches 42 of the present invention may provided in one of a number of known forms. For example, the microswitches 42 may be mechanical in nature, or may be provided by reed switch technologies. Other suitable arrangements, which may be employed to indicate when a tablet container 16 is accessed, are contemplated and considered within the scope of the invention.

Referring again to FIG. 3, there is provided a wireless port 46 and a communication module 48. Each port is included to enable the system unit 12 to receive and send information related to the operation of the tablet dispensing system 10. The wireless port 46, which may be accessed via optical portal 28 (of FIG. 1A) enables information to be exchanged with a nearby host computing means. The information exchanged with the host (not shown) may include programming and configuring information including one or more of the present time of day, the current date, at least one tablet container designation, at least one time of day that the designated tablet containers are to be accessed to remove tablets therefrom, and the number of tablets that constitute each dosage to be removed from each tablet container and ingested. The terms "designated tablet container" and "tablet container designation" will be defined as a designation, possibly in the form of a letter, number, or the like, placed on each tablet container 16 to indicate to the wearer which tablet container is to be accessed to remove and subsequently ingest one or more tablets therefrom. The communication module 48 is provided for establishing a communication link 48*a* to support the exchange of information with a host computing means to enable the host computing means to determine if the wearer has accessed the proper tablet containers as instructed by the prompts and messages issued to the wearer. This may be very helpful when prompts are issued to persons that are not responding to the prompts. For example, if the wearer is a hospital patient or nursing home patient who has fallen a sleep, the host computing means may notify the appropriate persons to indicate the non-responsive patient should be checked.

It is important to distinguish the functions of the wireless port 46 and the communication module 48. The wireless port 46 is utilized when a tablet dispensing system 10 is loaded (with tablets) and programmed with the appropriate information required for the operation and functioning of the system 10 (as discussed above). In contrast, the communication module 48 is included to support the establishing of a communication link 48*a* to support the exchange of information with a host computing means to enable the host computing means to determine if the wearer has accessed the proper tablet containers as indicated by the issued prompts, or alternately to determine if the wearer has inadvertently accessed the wrong tablet container 16. Further, it should be noted that the communication module 48 may establish a communication link 48*a*, as required, to indicate to the host computing means if a tablet container is accessed and the wearer has not been instructed to do so via issued prompts.

The general operation of the tablet dispensing system may be provided in many forms using many differing methods. An illustrative mode of operation will be provided for clarity, but should not be construed to limit the operational and functional scope of the invention. Further, it is contemplated that professionally trained persons, possibly nurses and pharmacists, may be employed to prepare and program/configure one or more respective tablet dispensing systems 10 for the particular tablets and their associated schedule for ingesting the stipulated dosages. Therefore, assume that the tablet containers 16 have been filled wherein each container is utilized to hold a different medicinal tablet. In addition, assume that the times or time intervals required to ingest each tablet have been programmed into the system unit 12, possibly by way of the momentary button switches 26, or downloaded via the wireless port 46. When a point in time is reached where a dosage is to be ingested, an audio prompt is issued via the system unit 12 to the wearer. The prompt may simply be in the form of one or more audio tones. For example, if the tablet containers 16 are numbered, say 1 through 4, a series of three tones may be employed to indicate to the wearer to remove and ingest one tablet from the tablet container numbered with a "3". In this example, the display 22 may be employed to further indicate which tablet container 16 is to be accessed and the number of tablets to be removed therefrom and ingested. Alternately, the prompts may be provided by way of one or more voice synthesized audio messages. Again, the display 22 may be employed to further indicate which tablet container 16 to access and the proper number of tablets to ingest. If several different tablets are to be ingested at the same time, the tablet dispensing system 10 may repeat the above procedure for each respective tablet container 16 to be accessed.

The inclusion of a microswitch 42 (shown in FIGS. 2 and 3) with each tablet container 16 may be utilized to indicate to the system unit 12, and specifically to the controller and timer module 30, when at least one of the tablet containers are accessed. This provides a means to verify that the correct tablet container is accessed, if a wearer is not responding to issued prompts, or if a tablet container 16 is accessed at an inappropriate time. In addition, if a prompt is issued and the controller and timer module 30 does not detect that the indicated tablet container 16 has been accessed (to remove tablets therefrom) within a predetermined period of time, the system 10 may reissue the previously issued audio prompts, and continue to periodically issue follow-up prompts and messages until the respective tablet container is accessed.

While there have been described the currently preferred embodiments of the present invention, those skilled in the art will recognize that other and further modifications may be made without departing from the present invention and it is intended to claim all modifications and variations as fall within the scope of the invention.

What is claimed is:

1. A portable strap-on tablet dispensing system to hold a plurality of tablets and indicate to a wearer the proper times to ingest at least one of the tablets, the system comprising:

(a) a programmable system unit arranged to issue one or more predetermined prompts to the wearer at predetermined time intervals, the prompts issued to indicate to the wearer that at least one of the plurality of tablets is to be ingested;

(b) a strap means arranged to enable the tablet dispensing system to be strapped on the wearer; and (c) a plurality of accessible tablet containers attached to the strap means and configured to hold a plurality of tablets therein, each tablet container assigned a designation and having an internal compartment to securely hold tablets and further including an access arrangement providing access to the internal compartment to remove at least one tablet therefrom; and (d) a plurality of microswitches, one installed on each of the tablet containers, operatively coupled to the programmable system unit so as to indicate thereto when at least one of the tablet containers are accessed, and thereby provide a verification means to verify that the indicated and correct tablet container is accessed;

(e) the system unit programmed to issue prompts to indicate to the wearer at least one designated tablet container to access tablets therefrom, and the number of tablets to ingest;

(f) the system unit further programmed to indicate to the wearer when at least one of the wrong tablet containers is being accessed as indicated by at least one the plurality of microswitches, after a prompt has been issued.

2. The system according to claim 1, wherein the system unit further includes a communication module for establishing a communication link to support the exchange of information with a host computing means.

3. The system according to claim 2, wherein the system unit is arranged to determine and indicate to the host computing means, after prompting, at least one of:

(a) if a container has not been accessed by the wearer; and (b) if the wearer has accessed the wrong tablet container.

4. The system according to claim 2, wherein the system unit is comprised of:

(a) a programmable controller and timer module;

(b) a wearer interface coupled to the controller and timer module, the wearer interface including a display and momentary button switches; the display provided to indicate information to the wearer including visually issued messages, and the momentary button switches provided to enable the wearer to input information and responses to the controller and timer module of the system unit; and (c) an audio output unit to issue prompts in the form of audio messages and tones to the wearer at predetermined times.

5. The system according to claim 4, wherein at the point in time that at least one tablet is to be ingested the system will issue appropriate audio prompts and continue to periodically issue follow-up prompts until the respective tablet container is accessed.

6. The system according to claim 5, wherein the audio prompts include voice synthesized messages.

7. The system according to claim 1, wherein the system unit further includes a wireless port to enable information to be exchanged with a host computing means to enable the programming and configuring of the system unit of the tablet dispensing system, the information exchanged including at least one of the time of day, the date, at least one tablet container designation, at least one time of day that the designated tablet containers are to be accessed to remove tablets therefrom, and the number of tablets that constitute each dosage to be removed from each tablet container and ingested when prompted.

8. The system according to claim 7, wherein the wireless port is provided by an optical infrared communication link.

* * * * *